US005538442A

United States Patent [19]

Okada

[11] Patent Number: 5,538,442

[45] Date of Patent: Jul. 23, 1996

[54] COMMUNICATION CARD

[75] Inventor: Masanobu Okada, Kyoto-fu, Japan

[73] Assignee: Murata Mfg. Co., Ltd., Japan

[21] Appl. No.: 316,510

[22] Filed: Sep. 30, 1994

[30] Foreign Application Priority Data

Oct. 4, 1993 [JP] Japan ..... 5-058543 U
Aug. 24, 1994 [JP] Japan ..... 6-222593

[51] Int. Cl.[6] ..... H01R 23/02

[52] U.S. Cl. ..... 439/676; 439/344; 439/946

[58] Field of Search ..... 439/676, 344, 439/638, 374, 946, 131, 55, 76.1, 359

[56] References Cited

U.S. PATENT DOCUMENTS

| | | | |
|---|---|---|---|
| 5,139,439 | 8/1992 | Shie | 439/359 |
| 5,183,404 | 2/1993 | Aldous et al. . | |
| 5,336,099 | 8/1994 | Aldous et al. | 439/344 |
| 5,338,210 | 8/1994 | Beckham et al. | 439/344 |
| 5,391,083 | 2/1995 | Roebuck et al. | 439/638 |
| 5,411,405 | 5/1995 | McDaniels et al. | 439/676 |

*Primary Examiner*—Neil Abrams
*Assistant Examiner*—Yong Kim
*Attorney, Agent, or Firm*—Howell & Haferkamp

[57] ABSTRACT

A modular fitting open slit, which is open at its rear end part, for freely inserting a modular plug into and removing it from said modular fitting open slit is provided at a rear end part of a modem card, and said open slit is provided with inner walls which function as a guide part for setting a direction of insertion of a modular plug, an extreme end position setting part for positioning an extreme end of said modular plug which is inserted, a return prevention part for engaging with said modular plug inserted to prevent it from coming off and terminals which function as a terminal connecting part which is electrically connected to the terminals of the modular plug. Said open slit is provided with L-shaped guide members for guiding insertion of said modular plug with their base sides set to be pivotally turnable and said guide members are formed to be freely remountable in said open slit. For inserting the modular plug into the open slit, the guide members are turned to make their L-shaped inner walls serve as the guide surfaces for positioning insertion of the modular plug. Thus the present invention enables to easily and accurately insert the modular plug insert into said open slit and provide a communication card which is not obstructive even when it is kept loaded in a personal computer or the like.

24 Claims, 7 Drawing Sheets

COMMUNICATION CARD

BACKGROUND OF THE INVENTION

1. Field of the Invention

The present invention relates to a communication card provided with a communication circuit.

2. Description of the Prior Art

Lately communication cards each of which is provided with a communication circuit have widely been used for input/output control of transmitting and receiving signals between transmitting and receiving units such as personal computers, word processors and other computers and communication lines such as telephone lines. One of these communication cards is known as a modem card, which is adapted to convert digital signals to be transmitted from a transmitter/receiver equipment to analog signals and transmit these analog signals through a communication line and, in turn, convert analog signals transmitted from the transmission line to digital signals and send these digital signals to the transmitter/receiver eqipment. This modem card is inserted as specified into a slot provided at the transmitter/receiver equipment and electrically connected to the equipment and, in addition, the transmitter/receiver equipment and the communication line are electrically connected through the communication circuit of the comminication card by reconnectably connecting a cord of the communication line such as the telephone line to the modem card to permit communication between personal computers.

An example of a modem card as well as a telephone line cord according to the prior art is shown in FIG. 1. In FIG. 1, a connector part of 14 mm in thickness is built in a rear end side of a modem card of approximately 5 mm in thickness and a modular fitting hole 20 for fitting a modular plug 2 provided at an extreme end of a cord 21 is formed in a connector part 23.

The modular plug 2 is provided with a lug 25 which is slantly protruded above a housing 24 as shown in FIGS. 11A, 11B and 11C and hooks 26 for preventing returning movement are provided as being protruded at both sides of the base of the lug 25. When the front end part of the lug 25 and a bottom of a housing 24 are held by fingers and a force is applied thereto, the lug is moved in a direction indicated with an arrow toward the upper surface 15 of the housing 24 as shown in FIG. 11A, comes in a state as shown in FIG. 11B and, when the fingers are released, the lug returns to its original position. A protruded part 27 which is protruded more than the front end face 28 of the housing 24 is provided on the upper front end part of the housing 24, a cord insertion hole (not shown) is formed at the rear end side of the housing 24, the cord 21 is inserted into the cord insertion hole, and four lead wires (not shown) extended from the cord 21 are arranged in the housing 24.

As shown in FIG. 3, six terminal accommodating slots 29 are formed at the bottom part of the housing 24 and terminals 30 are accommodated in four terminal accommodating slots 29 except for terminal accommodating slots 29 at both end sides, terminals 30 being electrically connected to the lead wires extended from the cord 21.

As shown in FIG. 2, the modular fitting hole 20 formed in the connector 23 of the modem card 1 is provided with an internal wall part 4 of the connector 23 which functions as a guide for setting an inserting direction of the modular plug 2, so that the modular plug 2 can be inserted into the inlet port through to the inner part of the modular fitting hole 20 along this internal wall part 4.

As shown in FIG. 4B, an extreme end position setting part 5 for positioning the extreme end of the modular plug 2, which is inserted into the inner part of the modular fitting hole 20 is provided. When the modular plug 2 shown in FIG. 4A is moved in an arrow direction and inserted into the modular fitting hole 20 of the connector 23 shown in FIG. 4B, the protruded part 27 of the modular plug 2 comes in contact with the extreme end position setting part 5 to prevent the modular plug 2 from advancing more.

A return prevention part 6 for engaging with the modular plug 2 inserted to prevent the modular plug 2 from coming off is provided at the upper part of the inlet port of the modular fitting hole 20, and the rear end part of the hook 26 of the modular plug 2 engages with the return prevention part 6 shortly before the protruded part 27 of the modular plug 2, which is inserted into the inner part of the modular fitting hole 20, comes in contact with the extreme end position setting part 5 of the modular fitting hole 20 whereby the modular plug 2 returns to the inlet port 22 of the modular fitting hole 20 and the modular plug 2 is prevented from coming off from the modular fitting hole 20.

For removing the modular plug 2 from the modular fitting hole 20, the lug 25 of the modular plug 2, which is protruded out of the modular fitting hole 20, is pushed down by a finger to approach the upper surface 15 of the housing 24 as shown in FIG. 4C and the hook 26 is kept released from the return prevention part 6 whereby the modular plug 2 can be removed from the modular fitting hole 20.

As shown in FIG. 2, six terminal accommodating slots 18 are formed at the lower part of the modular fitting hole 20 and the front end parts of connection terminals 8 are connected to four terminal accommodating slots 18 except the terminal accommodating slots 18 at both side ends whereby the arranging area of these connection terminals 8 functions as a terminal connecting part to be electrically connected with terminals 30 of the modular plug 2.

The modem card formed as described above is inserted from its front end into the slot of the personal computer as described above and the modular plug 2 at the extreme end side of the cord 21 is inserted into the connector part 23 at the rear end side of the card as shown in FIG. 1.

However, there has been a problem that, when the modem card 1 was set in the personal computer, the connector 23 at the rear end part of the modem card 1 protrudes from the body of the personal computer and the thick connector 23 which protrudes from the body of the personal computer or the like would be obstructive. In most cases, the personal computer has been moved with the modem card 1 kept inserted into the personal computer after disconnecting the modular plug 2 from the connector part 23 and therefore there has been a problem that the thick connector part 23 protruding out of the personal computer body might be struck with a desk or the like to cause the modem card 1 and the personal computer body to malfunction.

In addition, there has been a problem, if the rear end part of the modem card 1 is made to be thick to provide the connector part 23 in making the modem card 1, costs of materials and the modem card would be more expensive.

This type of modem card includes a problem that it is difficult to determine a position for inserting the modular plug into the modem card and therefore the modular plug may be erroneously inserted.

SUMMARY OF THE INVENTION

An object of the present invention made to solve the above problems is to provide an inexpensive communication card such as a modem card which is not obstructive when it is installed in a personal computer or the like.

Another object of the present invention is to provide a communication card capable of ensuring easy and positive insertion of the modular plug.

An aspect of the present invention is constructed as described below to attain the above-described objects. Specifically, the present invention is characterized in that a modular fitting open slit which is open at its rear end part for remountably inserting a modular plug is provided at a rear end side of a card having a communication circuit, and the open slit is provided with a guide part for setting an inserting direction of the mudular plug, an end position setting part for positioning the extreme end of the modular plug inserted, a return prevention part for engaging with the modular plug to prevent it from comming off, and a terminal connection part to be electrically connected to the terminal of the modular plug. It is referable to provide a recess between two return prevention parts. The recess serves to prevent the modular slit from slipping out of the open slit in the direction of a card by the mating of the lug of the modular plug with the recess. As a preferable modification, the present invention is such that a slide accommodating hole is provided at the rear end part of the card, a slide plate which can be inserted and removed as required is attached to the card and the modular fitting open slit is provided in the slide plate.

In the present invention with the above construction, the modular fitting open slit is provided with the guide part, the extreme end position setting part and the return prevention part whereby the inserting direction of the modular plug is set by the guide part and the modular plug is inserted, the extreme end of the modular plug inserted is positioned by the extreme end position setting part, and the modular plug is prevented from returning to the rear end part of the modular fitting open slit by the return prevention part and engaged for preventing from comming off. When the modular plug is inserted into the modular fitting open slit as described above, a hook of the modular plug engages with the return prevention part and a lug of the modular plug mates with a recess formed between the return prevention parts, and the terminal of the modular plug is electrically connected to the terminal connection part of the modular fitting open slit.

In another aspect of the present invention, the modular fitting open slit is provided with the guide part, the extreme end position setting part, the return prevention part, and the terminal connecting part. Even if the modular plug is protruded in the direction of the card thickness when the modular plug is connected to the modular fitting open slit, the modular plug is engaged with the modular fitting open slit to be prevented from coming off and kept connected electrically and therefore the rear end part of the card can be as thick as the front end part to enable reduction of the card thickness.

The present invention is characterized in that the modular fitting open slit which is open at its rear end for remountably inserting and removing the modular plug is provided at the rear end part of the card provided with the communication circuit, an L-shaped guide for inserting and positioning the modular plug is provided with its base to be turnable at the modular fitting open slit, the L-shaped guide is formed to be accommodatable in the modular fitting open slit, and a L-shaped inner wall of the guide serves as a guide surface for inserting and positioning the modular plug by turning the guide when the modular plug is inserted through the inlet port.

The present invention is characterized to have a construction that a slide accommodating hole is provided at the rear end part of the card, a slide plate which can be inserted into and removed from this slide accommodating hole is attached to the card, and the slide plate is provided with the modular fitting open slit.

Furthermore, the present invention is characterized in that a pair of L-shaped guides are provided to oppose each other and a concavity is formed at one front free end of the pair of guides and a projection which mates with this concavity is formed at the other free end of the pair of guides so that the concavity and the convexity of the guides mesh with each other when this pair of guides are accommodated in the modular fitting open slit.

In the above construction of the present invention, when the L-shaped guide, which is formed to be accommodatable in the modular fitting open slit with its base kept to be turnable, is turned in order to insert the modular plug into the modular fitting open slit, the guide is drawn out from the modular fitting open slit and the L-shaped inner wall of the guide serves as a guide surface for inserting and positioning the modular plug. The modular plug is guided by this guide surface and the insertion position of the modular plug is determined and the modular plug can be easily and positively inserted into the modular fitting open slit.

The modular plug which has been inserted into the open slit is retained not to slip therefrom by means of the L-shaped guide, the extreme end position setting part and the recess formed between the return prevention parts.

DETAILED DESCRIPTION OF THE PREFERRED EMBODIMENTS

Figure 1:
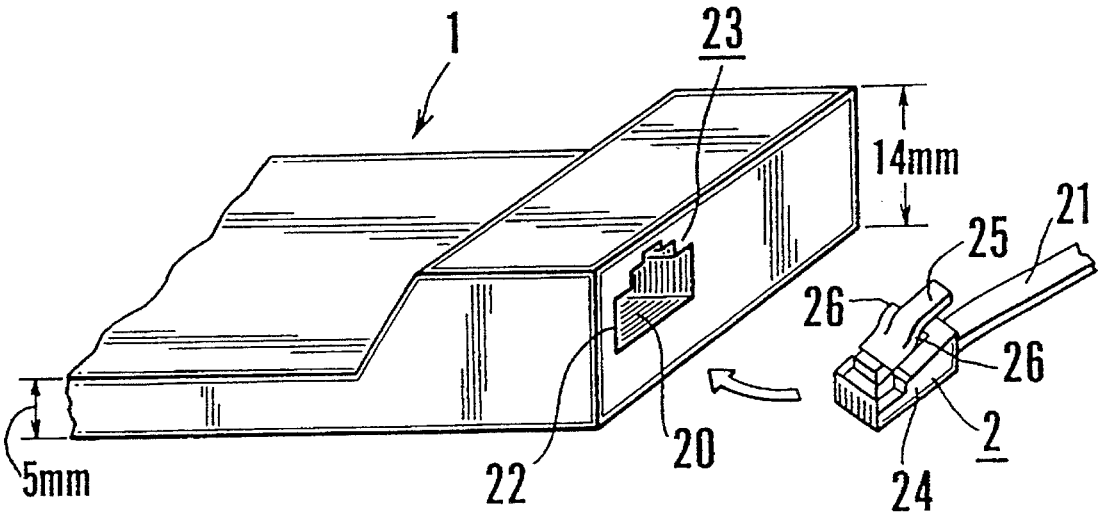
FIG. 1 PRIOR ART
FIG. 1 is an illustration showing a modem card and a cord for a telephone line according to the prior art.
Figure 2:
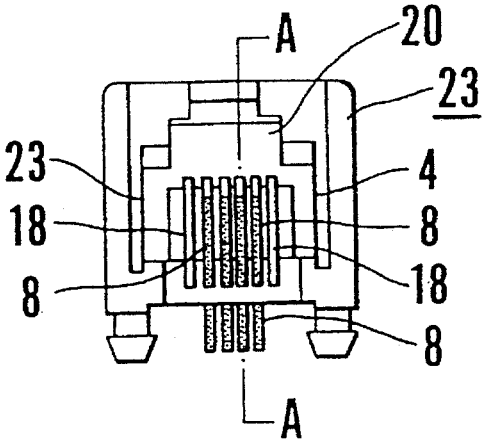
FIG. 2 is an illustration showing an internal construction of a modular fitting hole of a modem card shown in FIG. 1.
Figure 3:
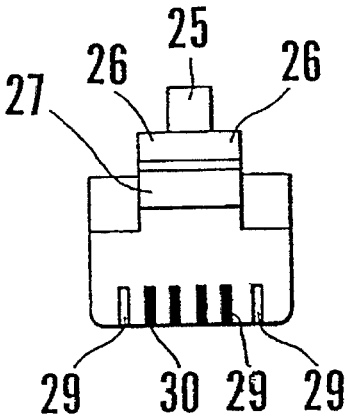
FIG. 3 is an end plane view as viewed from an extreme end of a modular plug.
Figure 4A:
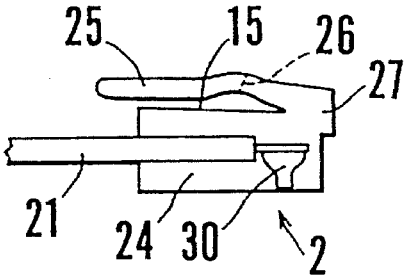
FIGS. 4A, 4B and 4C are respectively an illustration explaning a method of connection between the connector and the modular plug.
Figure 4B:
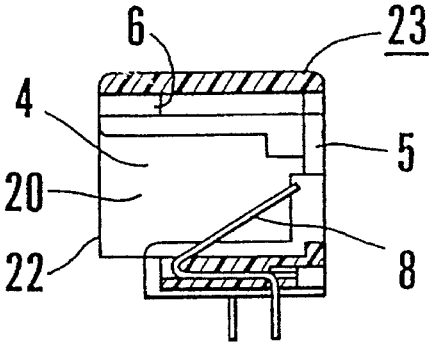
Figure 4C:
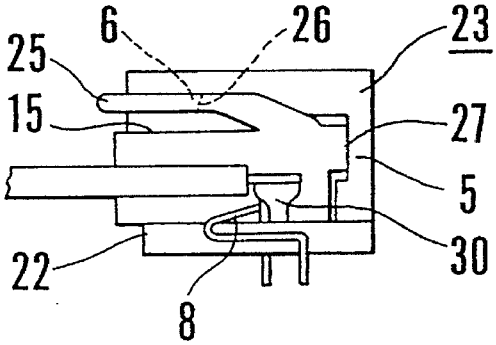
Figure 5:
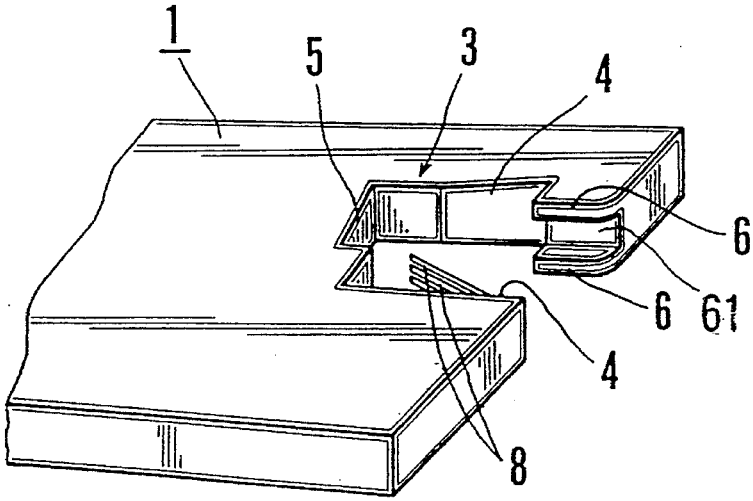
FIG. 5 is a perspective view showing an important part of a first embodiment of a communication card according to the present invention.

A preferred embodiment of the present invention is described below, referring to the accompanying drawings. In the description of this embodiment according to the present invention, the parts with the same descriptions as those of the prior art are given the same reference numerals and detailed description of these parts is omitted. A first embodiment of a modem card which is a communication card according to the present invention is shown in FIG. 5. A characteristic point of this embodiment different from the prior art example is that a modular fitting open slit (hereafter referred to as "open slit") 3, which is open at its rear end for remountably inserting and fitting a modular plug 2, is provided at the rear end part of the card, and the open slit 3 is provided with an inner wall part 4 which functions as a guide part, an extreme end position setting part 5, a return prevention part 6, a recess 61 formed between two return prevention parts 6, 6 and a terminal 8 for connection which functions as a terminal connecting part is provided. A thickness of the modem card 1 is uniformly 5 mm.

Figure 6A:
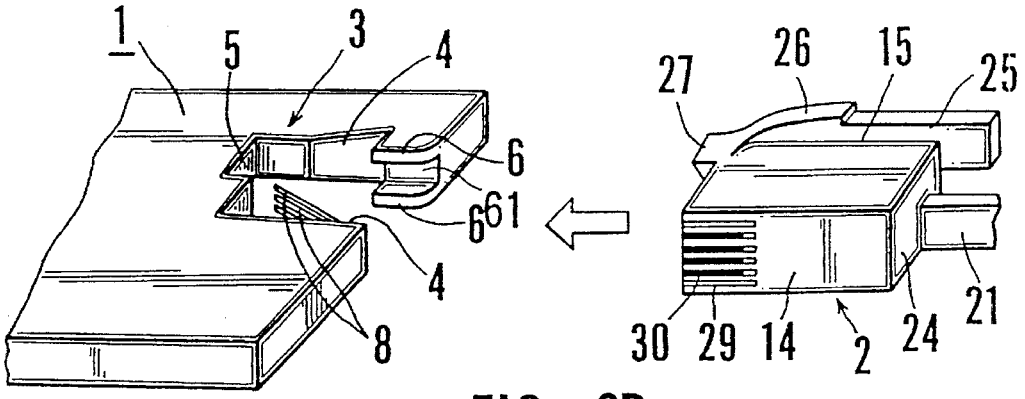
FIGS. 6A and 6B are respectively an illustration of a method of connection of the modular plug in the first embodiment shown in FIG. 5.

In this embodiment, the inner wall part 4 which functions as the guide part, the return prevention part 6 and the terminal 8 are provided on the side wall of the open slit 3. As shown in FIG. 6A, the modular plug 2 is connected to the modem card 1 in the arrow direction in a manner that the modular plug 2 is turned by 90 degrees from a position that a terminal 30 of the modular plug 2 and the terminal 8 of the modem card 1 are opposed each other, that is, a position that an arranging part of terminals 30 of the modular plug 2 is faced down as in the prior art example, to face an upper surface 15 of a housing 24 toward the background in the drawing and the bottom surface 14 toward the foreground in the drawing.

Figure 6B:
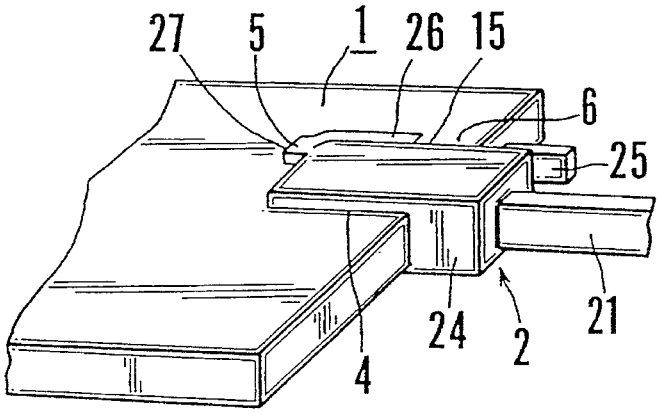
Figures 7A, 7B:
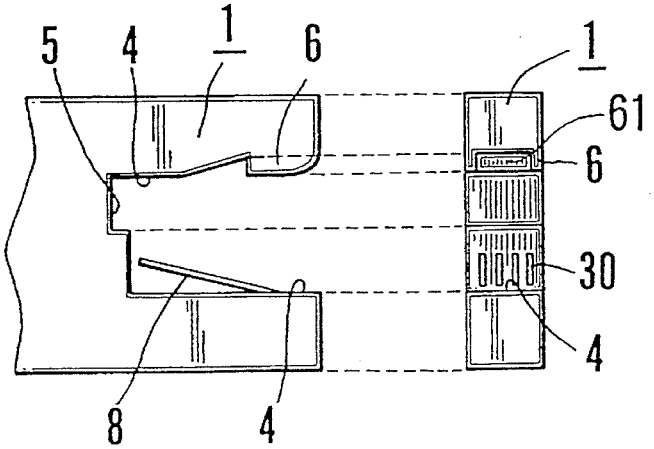
FIG. 7A is a plan view of an important part of the first embodiment of the communication card.
FIG. 7B is an end plane view as viewed from the rear end side of the communication card.
Figure 8A:
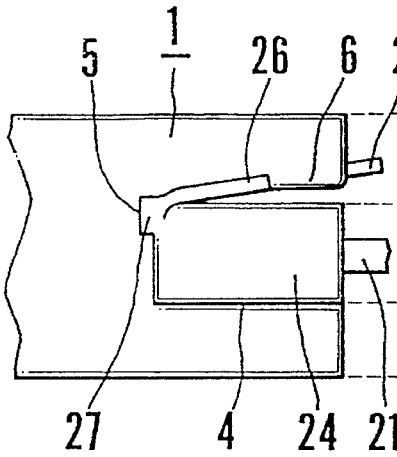
FIG. 8A is a plan view when the modular plug is connected to the first embodiment of the communication card.
Figure 8B:
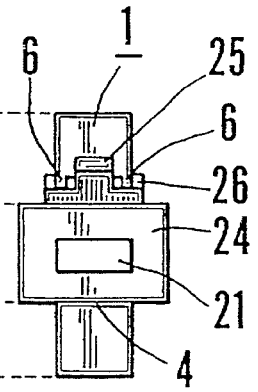
FIG. 8B is an end plane view as viewed from the rear end side of the communication card.

In this case, the modular plug 2 is inserted into the modem card 1 along the inner wall part 4 of the open slit 3 of the modem card 1 and a front end of a protruded part 27 of the modular plug 2 comes in contact with an extreme end position setting part 5 of the open slit 3 as shown in FIG. 6B and is prevented from further advancing. Under this condition, a rear end part of a hook 26 is engaged with the return prevention part 6 of the open slit 3, the lug 25 of the modular plug 2 is engaged with the recess 61 formed between the return prevention parts 6, 6, so that the modular plug 2 is secured into the open slit 3, and therefore the modular plug 2 is returned to the rear end part of the open slit 3 to be prevented from coming off and fitted into the modem card 1 while the modular plug 2 protrudes in direction of thickness of the modem card 1. When the modular plug 2 is fitted into the open slit 3, the terminals 30 of the modular plug 2 and the terminals 8 of the modem card 1 are electrically connected. FIGS. 7A and 8A respectively show a plan view of the rear end part of the modem card before and after the modular plug 2 is fitted to the modem card 1 and a view from the rear end side (right end side in the drawings).

The modular plug 2 can be removed from the open slit 3 by pushing down the lug 25 of the modular plug 2 toward the upper surface 15 of the housing 24 so as to prevent the hook 26 of the modular plug 2 from being held by the return prevention part 6 of the open slit 3 and draw out the modular plug 2 toward the rear end side of the open slit 3. When the modular plug 2 is removed from the open slit 3, the terminals 30 of the modular plug 2 are disconnected from the terminals 8 of the modem card 1.

According to this embodiment, the modular plug 2 can be remountably fitted to the open slit 3 as described above and the terminals 30 of the modular plug 2 can be reconnectably connected to the terminals 8 of the modem card 1 for electrical connection.

In the prior art example, the guide part is formed on the inner wall part 4 at the side wall side of the modular fitting hole 20, and the extreme end position setting part 5, the return prevention part 6 and the terminals 8 are provided on the upper or lower side of the inner wall of the modular fitting hole 20 and therefore the modular fitting hole 20 should be formed as a hole which has a width and a height equivalent to the width and the height of the modular plug 2 and the connector part 23 should have a wall as thick as to sufficiently surround the modular fitting hole 20. In this embodiment, however, the inner wall part 4 serving as the guide part, the return prevention part 5 and the terminals 8 are provided on the inner wall side of the side end of the open slit 3 and the extreme end position setting part 5 is provided on the inner wall side Of the extreme end side of the open slit 3 and therefore the upper and lower walls of the open slit 3 are not required and the rear end part of the modem card 1 need not be thick, differing from the prior art example.

As described above, the modular plug 2 is inserted into the open slit 3 while the thickness of the modular plug 2 exceeds to protrude from the modem card 1 in the direction of thickness of the modem card 1 by inserting the modular plug 2 in a different direction from the prior art example, and the modular plug 2 can be effectively fitted even though the thickness of the rear end part of the modem card 1 is not increased.

Since the modem card 1 of this embodiment is not thick at its rear end part, the rear end part is not obstructive, differing from the prior art example and therefore the possibility of hitting the rear end part of the modem card 1 against a desk or the like during movement of a personal computer can be reduced unlikewise the prior art example.

The modem card 1 can be produced only by forming the open slit 3 at the rear end part of the card 1 and providing the terminals 8 at the open slit 3 and, therefore, the modem card can be easily produced and costs of materials for forming the connector part 23 can be saved differing from the prior art example according to which a thick connector part 23 is purposively formed.

Figure 9:
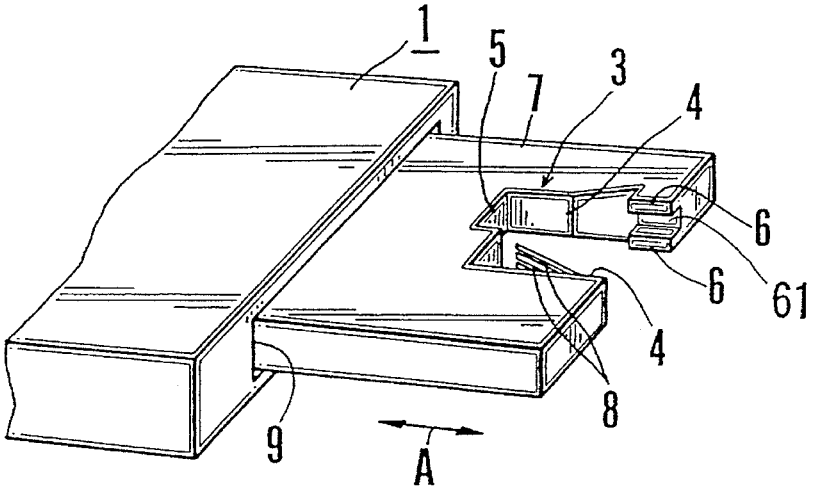
FIG. 9 is a perspective view showing an important part of a second embodiment of the communication card according to the present invention.

A second embodiment of the modem card which is the communication card according to the present invention is shown in FIG. 9.

The second embodiment differs from the first embodiment in that a slide accommodating hole 9 is provided in the rear end part of the modem card 1, a slide plate 7 which can be freely inserted into this slide accommodating hole 9 and has a uniform thickness is fitted in the slide accommodating hole 9 and the open slit 3 is provided in the rear end part of the slide part 7. The slide plate 7 can be freely inserted into and removed from the slide accommodating hole 9 by sliding the slide plate 7 in the arrow direction in the drawing.

As disclosed in the U.S. Pat. No. 160,253 filed by the present inventor, a pushing-out means such as a spring for pushing out the slide plate 7 from the slide accommodating hole 9, a slide plate holding means (not shown) for retaining the slide plate 7 in the slide accommodating hole 9, and a slide plate emgaging means for holding the slide plate at a drawing-out position when the slide plate is drawn out are provided between the slide plate 7 and the modem card 1; therefore, the slide plate 7, which is usually held by the slide holding means in the slide accommodating hole 9, is pushed out by the pushing-out means and ejected from the slide accommodating hole 9 when a holding force of the slide plate holding means is released by, for example, operation means. Then the slide plate 7 is held as drawn out by the slide plate engaging means which engages with the slide plate 7 pushed out from the slide accommodating hole 9.

When this modem card 1 is loaded into the slot of a personal computer or the like, the modem card 1 is completely inserted into the slot up to its rear end and only the slide plate 7 is protruded out of the personal computer body. The modular plug 2 is inserted into the open slit 3 of the slide plate 7.

In the second embodiment as in the first embodiment, the modular plug 2 can be freely fitted into the open slit 3 to obtain a similar effect to that in the first embodiment. Also in the second embodiment, the slide plate 7 can be freely inserted into and removed from the slide accommodating hole 9 of the modem card 1 as required and therefore the rear end of the modem card 1 will not be protruded out of the personal computer unit if the slide plate 7 is kept accommodated in the slide accommodating hole 9 and the modem card will not be obstructive if it is loaded on the personal computer. Accordingly, even if the personal computer is moved with the slide plate 7 kept accommodated in the slide accommodating hole 9, the rear end part of the modem card 1 will not be struck against the personal computer desk.

Figure 10:
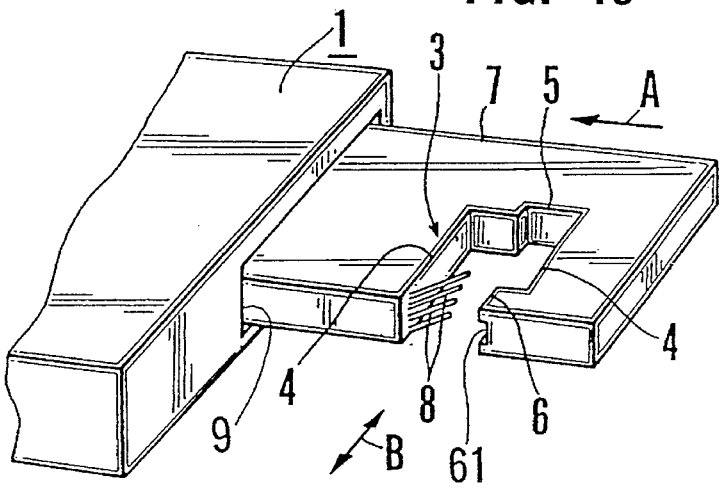
FIG. 10 is a perspective view showing an important part of a third embodiment of the communication card according to the present invention.
Figure 11A:
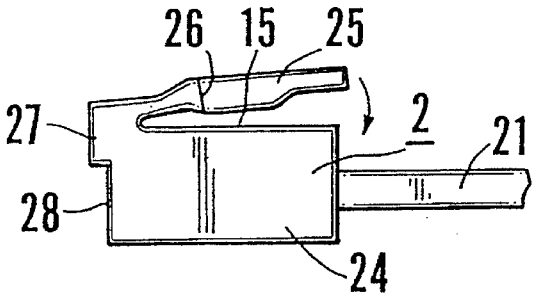
FIGS. 11A, 11B and 11C are respectively an illustration explaining an operation of a lug of a modular plug 2.
Figure 11B:
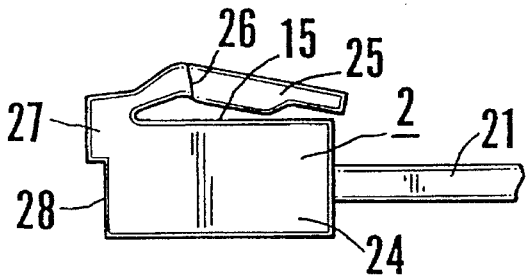
Figure 11C:
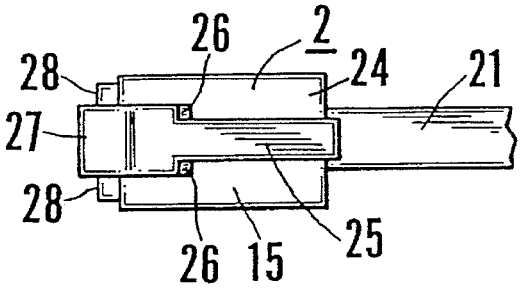

A third embodiment of the modem card which is the communication card according to the present invention is shown in FIG. 10. The third embodiment differs from the second embodiment in that the open slit 3 is provided at the side end of the slide plate 7. In the third embodiment as in the second embodiment, the modular plug 2 can be freely inserted into and removed from the open slit 3 by moving the modular plug 2 in the direction of arrow B in the drawing to obtain a similar effcet.

In the third embodiment, since the open slit 3 is formed at the side end of the slide plate 7, the open slit 3 is concealed inside the card 1 to improve the appearance and free from intrusion of dust through the inlet side of the slide accommodating hole 9 and the terminals 8 located inside the open slit 3 are also free from depositing of dust when the slide plate 7 is moved in the direction od arrow A and accommodated in the slide accommodating hole 9 of the modem card 1.

The present invention is not limited to the embodiments as described above and is available in various modes of embodiments. For example, though the open slit 3 is provided at the front side end of the slide plate 7 in the third embodiment, the open slit 3 can be provided at the opposite side end of the slide plate. The thickness of the slide plate 7 is not always uniform as in the embodiments.

Figure 12:
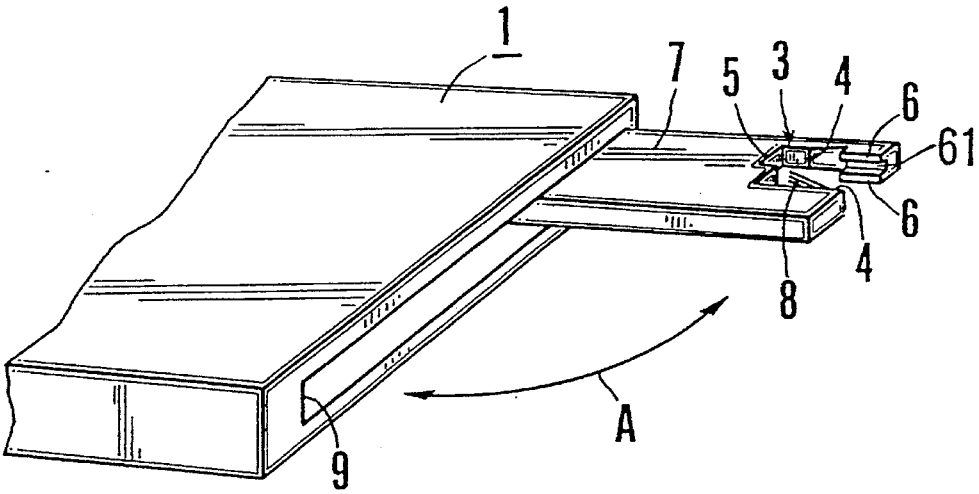
FIG. 12 is a perspective view showing an important part of a fourth embodiment of the communication card according to the present invention.

In the above embodiments, the modem card 1 is adapted so that the slide plate 7 is freely inserted into and removed from the slide accommodating hole 9 by means of a spring in the direction of arrow A as shown in FIGS. 9 and 10; however, the modem card 1 can be adapted so that the slide plate 7 is freely inserted into and removed from the slide accommodating hole 9 by means of the spring while adapting the slide plate 7 to be turnable around a pivotal point (not shown) in the slide accommodating hole 9 as shown in FIG. 12.

Though the modem card 1 is given a uniform thickness of 5 mm in the above embodiments, the thickness of the modem card 1 is not limited to 5 mm and is not always uniform.

In addition, though four terminals 8 are provided at the open slit 3 in the above embodiments, the number of terminals 8 is not limited to 4 and can be as many as the number of terminals 30 of the modular plug 2 to be fitted to the open sliy 3.

Furthermore, the communication card according to the present invention is not limited to the modem card 1 as described in the above embodiments and can be the other type of communication card if it is provided with a communication circuit.

According to the present invention, the modular fitting open slit is provided at the rear end part of the card and, when the modular plug is inserted into the modem card along the guide part of the open slit, the modular plug is positined by the extreme end position setting part and the return prevention part and the recess 61 formed between the return prevention parts 6, 6 and engaged to prevent it from coming off whereby the terminals of the modular plug and the terminals provided on the open slit can be electrically connected easily.

In the present invention, functional component parts such as the guide part are formed at the side end part of the modular fitting open slit and therefore a wall need not be provided above and below the modular fitting open slit and the modular plug can be remountably fitted to the modular fitting hole effectively even though the modular plug protrudes in the direction of thickness of the card. For this reason, the rear end part of the card need not be thicker than the front end part unlikewise the prior art example and the card can be thin in thickness as a whole. The rear end part of the card will not be obstructive when it is loaded on an apparatus such as a personal computer and, for example, the rear end part of the card will rarely be struck against the personal computer desk during movement of the personal computer.

According to the communication card in which the slide accommodating hole is provided at the rear end part of the card, the slide plate, which can be freely inserted into and removed from the slide accommodating hole, is attched to the card, and the slide plate is provided with the modular fitting open slit, the slide plate can be accommodated in the slide accommodating hole, if unnecessary, to make the rear end part of the card concealed within the apparatus such as the personal computer so as not to be obstructive. If the card is adapted so, the rear end part of the card will not be obstructive and will never be struck against the personal computer desk ot the like during movement of the personal computer.

According to the present invention, differing from the prior art example, a thick connector part need not be provided and the card can be made thin in thickness as a whole and therefore costs of materials and the communication card can be saved accordingly.

Figure 13:
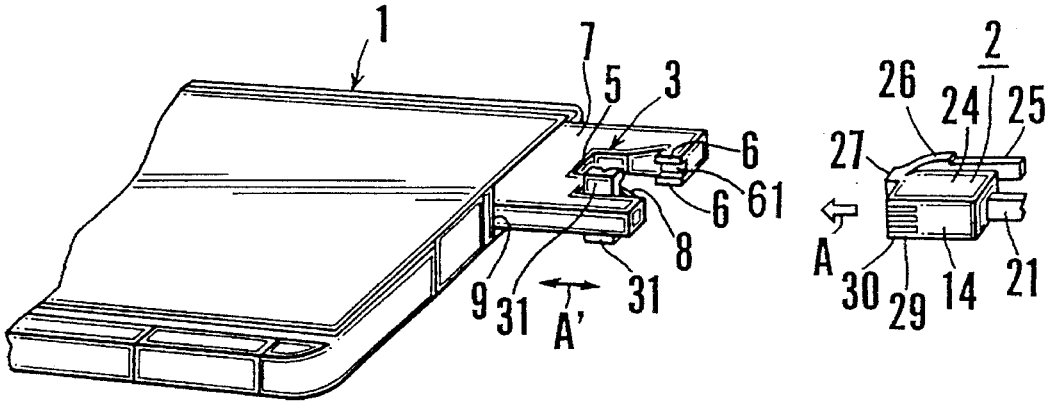
FIG. 13 is a perspective view showing an important part of a fifth embodiment of the communication card according to the present invention.

FIG. 13 shows a fifth embodiment of the modem card which is the communication card according to the present invention.

This embodiment is intended to prevent faulty insertion of the modular plug 2 into the open slit 3 of the modem card 1 and, in the description of this embodiment, the component parts with the same decsriptions as the modem card and the modular plug, which have been described in the foregoing paragraphs, are given the same reference numerals and the detailed description of these component parts are omitted.

An important construction of a modem card 1 which is the fifth embodiment of the communication card related to the present invention, as well as the modular plug 2, are shown in FIG. 13. A characteristic point of the fifth embodiment differing from the above embodiments is that the open slit 3 is provided with a guide 31 for positioning to guide insertion of the nodular plug 2 and this guide 31 is made remountable in the open slit 3.

Figure 14:
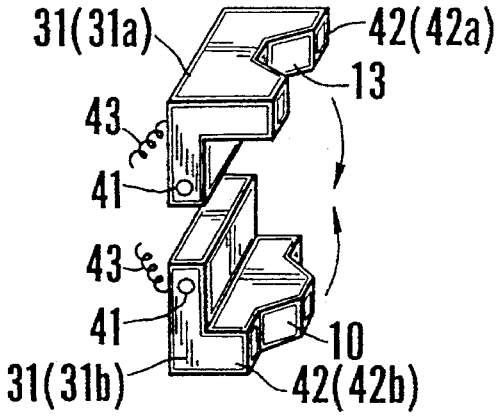
FIG. 14 is a perspective view of the guide of the fifth embodiment shown in FIG. 13.
Figure 15A:
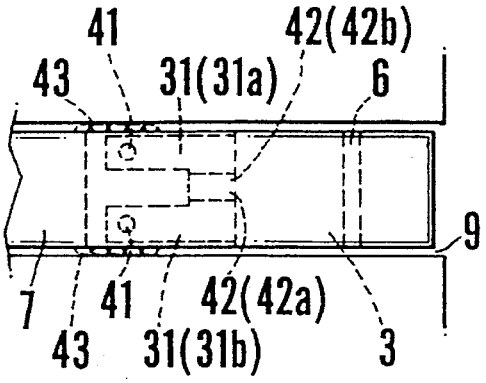
FIG. 15A is an illustration showing a slide plate of the fifth embodiment shown in FIG. 13, which is accommodated in a slide accommodating hole.

The guide 31 is L-shaped as shown in FIG. 14 with its base pivotably secured at the slide plate 7 and a pair of L-shaped guides 31 are provided facing each other. One guide 31*a* of this pair of guides 31 is provided on the surface side of the modem card 1 and a concavity 13 is formed at the front free end 42 of the the guide 13, while the other side guide 31*b* is provided on the rear surface of the modem card 1 and a convexity 10, which mates with the concavity 13, is formed at the front free end 42 of the guide 31*b*. When a pair of these guides 31*a* and 31*b* are turned as shown with arrows shown in FIG. 14 and fitted into the open slit 3 as shown in FIG. 15A, the concavity 13 of the guide 31*a* mates with the convexity 10 of the guide 31*b*. Therefore, even if the front free end parts 42 of the guides 31*a* and 31*b* are formed slightly longer, the guides 31*a* and 31*b* can be easily accommodated in the open slit 3.

Figure 15B:
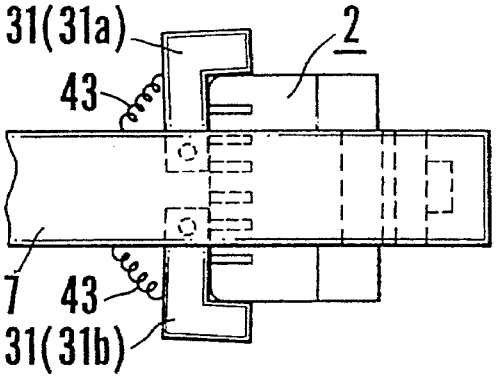
FIG. 15B is an illustration showing the slide plate which is drawn out from the slide accommodating hole and fitted with the modular plug.

As shown in FIGS. 14, 15A and 15B, a spring 43 is provided between the guides 31*a*, 31*b* and the slide plate 7. The outer walls of guides 31*a* and 31*b* are pushed by the inner wall of the slide accommodating hole 9 and the guides 31*a* and 31*b* are accommodated in the open slit 3 when the slide plate 7 is inserted into the slide accommodating hole 9 as shown in FIG. 15A, while a force of the inner wall of the slide accommodating hole 9 which holds the outer walls of the guides 31*a* and 31*b* is released and the guides 31*a* and 31*b* are turned by a force of the spring 43 and automatically drawn out from the open slit 3 when the slide plate 7 is drawn out from the slide accommodating hole 9. The guides 31*a* and 31*b* are pushed out to a position where they are approximately orthogonal to the slide plate 7 and a U-shaped surface formed by L-shaped inner walls of the guides 31*a* and 31*b* serves as a guide surface for positioning to guide insertion of the modular plug 2.

This embodiment is constructed as described above and, when this modem card 1 is loaded into a slot of an apparatus such as a personal computer, the card 1 up to its rear end is concealed inside the slot. When the slide plate 7 is drawn out from the slide accommodating hole 9, only the slide plate 7 is protruded out of the body of the apparatus and, at this time, the guides 31*a* and 31*b* are pushed out from the open slit 3 to respectively form an L-shaped guide surface. When the modular plug 2 is inserted into the inlet port of the open slit 3, the modular plug 2 is guided by the guides 31*a* and 31*b* and inserted into the modem card 1 along the U-shaped guide surface formed by the L-shaped inner walls of both guides 31*a* and 31*b* for positioning insertion of the modular plug.

Similar to insertion of the modular plug 2 into the modem card 1 shown in FIG. 6A, the front end of the protruded part 27 of the modular plug 2 comes in contact with the extreme end position setting part 5 of the open slit 3 and the front end position of the modular plug 2 is set while, under this condition, the hook 26 of the modular plug 2 engages with the return prevention part 6 of the open slit 3 and the modular plug 2 is returned to the rear end of the open slit 3 and prevented from coming off and therefore fitted to the modem card 1. Consequently, the terminals 30 of the modular plug 2 and the terminals 8 of the modem card 1 are electrically connected.

The modular plug is removed from the open slit 3 in a same manner as in removing of the modular plug 2 from the open slit 3 of the modem card 1. thus the modular plug 2 is remountably inserted into and removed from the open slit 3 and electrical connection of the modular plug and the modem card 1 is changed over as required.

According to this embodiment, the modular plug 2 is positioned in three directions along the U-shaped guide surface formed by the L-shaped inner walls of the guides 31*a* and 31*b* and inserted into the open slit 3 when the modular plug 2 is inserted into the open slit 3 and therefore the position of the modular plug 2 is certainly set and insertion of the modular plug 2 into the open slit 3 can be carried out sinply, accurately and quickly.

According to the above embodiments, the slide plate 7 can be inserted into and removed from the slide accommodating hole 9 as the modem card 1 shown in FIG. 5 and therefore, when the slide plate 7 is accommodated in the slide accommodating hole 9, the rear end part of the modem card 1 will not be protruded out of the personal computer or the like and the modem card 1 which is kept loaded in the personal computer will not be obstructive. Accordingly, even if the personal computer in which the slide plate 7 is kept accommodated in the slide accommodating hole 9, the rear end part of the modem card 1 will not be struck against the personal computer desk or the like.

In addition, in case of the modem card 1 of this embodiment as the modem card 1 shown in FIG. 5, the modular plug 2 is inserted into the modem card 1 by moving the modular plug 2 in a direction parallel to the card surface of the modem card 1 (a horizontal direction in the drawing) and therefore the modular plug 2 can be smoothly inserted into the modem card 1 either in a case where the modem card 1 is loaded in the personal computer or the like with its surface kept faced up or in a case where it is loaded with its surface kept faced down.

Figure 16:
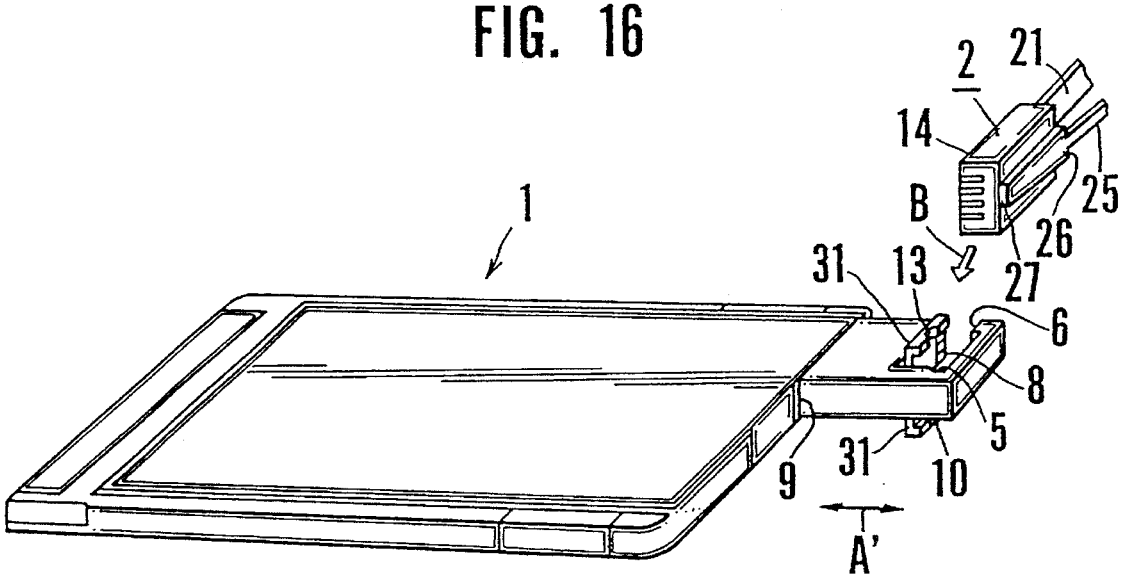
FIG. 16 is a perspective view showing an important part of a sixth embodiment of the communication card according to the present invention.

A sixth embodiment of a modem card which is a communication card according to the present invention is shown in FIG. 16. The sixth embodiment differs from the fifth embodiment in that the open slit 3 is provided at the side end part of the slide plate 7 in a direction which is approximately orthogonal to the direction where the slide plate 7 is inserted into and removed from the slide accommodating hole 9 (the direction of arrow A'). In the fifth embodiment as in the fourth embodiment, the modular plug 2 can be moved in the direction of arrow B in the drawing and remountably fitted into the open slit 3 to obtain a similar effect.

In the sixth embodiment, the open slit 3 is formed at the side end part of the slide 7 and, therefore, when the slide palte 7 is slid in the direction of arrow A' and accommodated in the slide accommodating hole 9 of the modem card 1, the open slit 3 is concealed inside the card 1 to improve the appearancxe and dust is prevented from entering into the open slit 3 though the inlet port of the slide accommodating hole 9 and depositing on the terminals 8 and other parts in the open slit 3.

The present invention is not limited to the embodiments described above and is also available in other various modes. For example, though, in the sixth embodiment, the open slit 3 is provided at the inner side end part of the slide plate 7, the open slit 3 may be provided at the front end part of the slide plate 7. The slide plate 7 is not always uniform in thickness, differing from the above embodiments.

Though, in the above embodiments, the slide plate 7 is adpated so as to be inserted into and removed from the slide accommodating hole 9 in the forward and backward direction as shown with the arrow A' in FIGS. 13 and 16 by means of a spring, the slide plate 7 may be turned around a pivotal point (not shown) in the slide accommodating hole 9, for example, as shown with the arrow A' in FIG. 12 to be freely inserted into and removed from the slide accommodating hole 9 by similarly using the spring.

Figure 17:
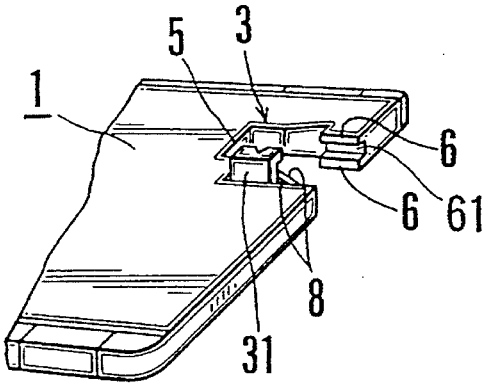
FIG. 17 is a perspective view showing an important part of a seventh embodiment of the communication card according to the present invention.

In the above embodiment, the slide accommodating hole 9 and the slide plate 7 are provided at the rear end part of the modem card 1 and the slide plate 7 is provided with the open slit 3. However, as shown in FIG. 17, the open slit 3 is directly provided at the rear end part of the modem card 1 without providing the slide accommodating hole 9 and the slide plate 7. The embodiments may be adapted so that, usually, the guides 31 are accommodated in the open slit 3 and, as required, drawn out from the open slit 3.

Furthermore, though, in the above embodiments, the guides 31 are adapted to be automatically pushed out by the spring 43 when the slide plate 7 is removed from the slide accommodating hole 9, the guides 31 may be automatically pushed out by a pushing-out means, except the spring, which is provided between the guides 31 and the slide plate 7 instead of the spring 43 or the guides 31 may be manually drawn out from the open slit 3 without providing the pushing-out means.

In addition, the fifth embodiment is adapted so that a concavity 13 is formed at the free front end 42 of one guide 31*a* of a pair of guides and a convexity 10, which mates with the concavity 13, is formed at the free front end 42 of the othrer guide 31*b*, and the concavity 13 and the convexity 10 of the guides 31*a* and 31*b* mate with each other when this pair of guides 31*a* and 31*b* are accommodated in the open slit 3. On the contrary, however, the convexity 10 may be formed at the guide 31*a* side and the concavity 13 may be formed at the guide 31*b* side, or the convexity 10 and the concavity 13 may be omitted. However, if the embodiment is adapted so that, the convexity 10 mates with the concavity 13 when the convexity 10 and the concavity 13 are formed at the guides 31*a* and 31*b* and the guides 31*a* nad 31*b* are accommodated in the open slit 3, the concavity 13 and the convexity 10 of the guides 31*a* and 31*b* mate with each other even though the free front ends 42 of the guides 31*a* and 31*b* are formed to be slightly longer, and the guides may be easily accommodated in the modular fitting open slit 3. Therefore such adaptation as described above is preferable.

Figure 18:
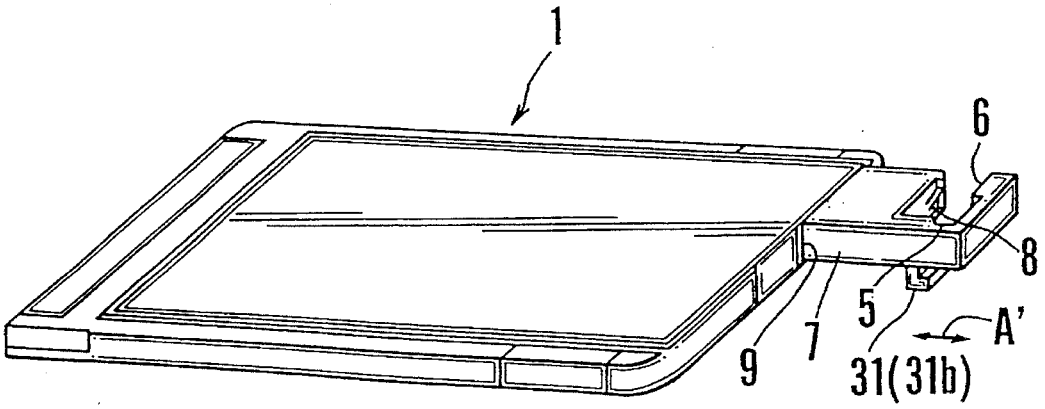
FIG. 18 is a perspective view showing an important part of a eighth embodiment of the communication card according to the present invention.

In the above embodiments, furthermore, though the guides 31 are provided both at the obverse surface side and at the rear side of the modem card 1, the guides 31 may be provided only on the rear side of the modem card 1 as shown in FIG. 18 and, on the contrary, only on the obverse surface of the modem card 1. As in the above embodiments, however, if a U-shaped guide surface for inserting and positioning the modular plug with the L-shaped inner walls of both guides 31*a* and 31*b* is formed by providing a pair of guides 31*a* and 31*b* on the obverse surface and the rear surface pf the open slit 3, insertion of the modular plug 2 into the open slit 3 can be carried out more easily, accurately and quickly than in the case of providing the guides 31 only at the obverse surface or the rear surface of the modem card 1 and using the L-shaped inner walls of the guides 31 as the guide surface for inserting and positioning the modular plug.

In addition, though, in the above embodiments, the thickness of the modem card 1 is uniformly 5 mm, the thickness of the modem card 1 is not always 5 mm and the modem card 1 is not always uniform in thickness.

Furthermore, the communication card according to the present invention is not limited to the modem card 1 as in the above embodiments and can be the other type of communication card if it is provided with a communication circuit.

According to the present invention, the L-shaped guides are turned and the L-shaped inner walls of these guides are used as the guide surface for inserting and positioning the modular plug when inserting the modular plug into the modular fitting open slit and therefore the position for inserting the modular plug can be accurately determined by this guide surface and the modular plug can be inserted easily, accurately and quickly into the modular fitting open slit.

According to the present invention, the modular fitting open slit is open at its ned face and the modular plug can be moved in a direction parallel to the card surface of the communication card from the end face side and inserted and, therefore, the modular plug can be smoothly inserted into the communication card either where the comminication card is loaded in the personal computer or the like with its obverse surface faced up or where the communication card is loaded in the personal computer with its obverse surface faced down, differing from the case where the modular plug is moved in a direction normal or oblique to the card surface from the obverse or rear surface of thre communication card and inserted into the open slit.

Furthermore, according to the present invention in which a pair of L-shaped guides are arranged to oppose to each other, the guide surface for inserting and positioning the modular plug which is formed by the L-shaped inner walls of this pair of guides can be U-shaped to enable to guide insertion of the modular plug in three directions by this guide surface whereby the modular plug can be more accurately positioned than in case of using the L-shaped inner wall of one guide as the guide surface for inserting and positioning the modular plug.

In addition, according to the present invention in which a concavity is formed at the free front end of one of a pair of guides and a convexity, which mates with the concavity, is formed at the free front end of the other of the pair of guides so that the concavity and the convexity of the guides mate with each other when this pair of guides are accommondated in the modular fitting open slit, the guides can be easily accommodated in the modular fitting open slit when the concavity mates with the convexity even though the free front end parts of the guides are formed to be slightly longer.

What I claimed is:

1. A communication card having a communication circuit, comprising:

a modular fitting open slit, being open at a portion, for freely inserting a modular plug and removing said modular plug;

said modular fitting open slit comprising:

a guide part for setting a direction of insertion of said modular plug;

an extreme end position setting part for positioning an extreme end of said modular plug as inserted;

a return prevention part for engaging said inserted modular plug to prevent said modular plug from coming off; and a terminal connecting part to be electrically connected to terminals of said modular plug.

2. A communication card having a communication circuit as claimed in claim 1 further comprising a groove formed between said return prevention parts for engaging a lug of said modular plug.

3. A communication card having a communication circuit as claimed in claim 1, wherein said modular fitting open slit is provided at said communication card.

4. A communication card having a communication circuit as claimed in claim 1, wherein said modular fitting open slit is provided at a rear end part of said communication card which is open at its rear end part.

5. A communication card having a communication circuit as claimed in claim 2, wherein said modular fitting open slit is provided at said communication card.

6. A communication card having a communication circuit as claimed in claim 2, wherein said modular fitting open slit is provided at a rear end part of said communication card which is open at its rear end part.

7. A communication card having a communication circuit comprising:

a slide accommodating hole provided at a rear end part of said communication card;

a slide plate for freely inserted into and removed from said slide accommodating hole, said slide plate being provided with a modular fitting open slit;

said modular fitting open slit comprising:

a guide part for setting a dirction of insertion of said modular plug;

an extreme end position setting part for positioning an extreme end of said modular plug as inserted;

a return prevention part for engaging said inserted modular plug to prevent said modular plug form coming off; and a terminal connection part to be electrically connected to terminals of said modular plug.

8. A communication card having a communication circuit as claimed in claim 7 further comprising a groove formed from two return prevention parts for engaging a lug of said modular plug.

9. A communication card having a communication circuit as claimed in claim 7, wherein said modular fitting open slit is provided at a rear end part of said slide plate which is open at its rear end part.

10. A communication card having a communication circuit as claimed in claim 8, wherein said modular fitting open slit is provided at a rear end part of said slide plate which is open at its rear end part.

11. A communication card having a communication circuit as claimed in claim 7, wherein said modular fitting open slit is formed at a side end part of said slide plae which is open at a portion.

12. A communication card having a communication circuit as claimed in claim 8, wherein said modular fitting open slit is formed at a side end part of said slide plate which is open at a portion.

13. A communication card having a communication circuit as claimed in claim 8, wherein said slide plate is adapted to be turnable around a pivotal point in a slide accomodating hole by means of a spring.

14. A communication card having a communication circuit, comprising:

a modular fitting open slit, being open at a portion, for freely inserting a modular plug and removing said modular plug;

said modular fitting open slit comprising:

guide members for guiding insertion of said modular plug, said guide members being formed to be remountable in said modular fitting open slit, and inner walls of said guide members being used as guide surfaces for inserting and positioning said modular plug by turning said guide members when said modular plug is inserted said modular fitting open slit;

an extreme end position setting part for positioning an extreme end of said modular plug as inserted;

a return prevention part for engaging said inserted modular plug to prevent said modular plug from coming off; and a terminal connecting part to be electrically connected to terminals of said modular plug.

15. A communication card having a communication circuit as claimed in claim 14 further comprising a groove formed two return prevention parts for engaging a lug of said modular plug.

16. A communication card having a communication circuit as claimed in claim 14, wherein a slide accommodating hole is provided at a rear end part of said communication card, a slide plate which can be freely inserted into and removed from said slide accommodating hole, said slide plate is provided with a modular fitting open slit.

17. A communication card having a communication circuit as claimed in claim 14, wherein said guide members are respectively L-shaped and arranged as a pair to oppose to each other.

18. A communicaiton card having a communication circuit as claimed in claim 17, wherein a concavity is formed at a free front end of one of a pair of guite members, and a convexity which mates with said concavity, is formed at a free front end of the other guide member and said concavity and convexity of said guide members mate with each other when a pair of guide members are accommodated in said modular fitting open slit.

19. A communication card having a communication circuit as a claimed in claim 15, wherein a slide accommodaring hole is provided at a rear end part of said communication card, a silde plate which can be freely inserted into and removed from said slide accommodating hole, said slide plate is provided with a modular fitting open slit.

20. A communication card having a communication circuit as claimed in claim 15, wherein said guide members are respectively L-shaped and arranged as a pair to oppose to each other.

21. A communication card having a communication circuit as claimed in claim 20, wherein a concavity is formed at a free front end of one of a pair of guide members, and a convexity which mates with said concavity, is formed at a free front end of the other guide member and said concavity and convexity of said guide members mate with each other when a pair of guide members are accommodated in said modular fitting open slit.

22. A communication card having a communication circuit as claimed in claim 14, wherein said modular fitting open slit is formed at a side end part of said slide plate which is open at a portion.

23. A communication card having a communication circuit as claimed in claim 15, wherein said modular fitting open slit is formed at a side end part of said slide plate which is open at a portion.

24. A communication card having a communication circuit as claimed in claim 15, wherein said guide member is L-shaped only at either obverse surface of said communication card.

* * * * *